US005403507A

United States Patent [19]

Henry

[11] Patent Number: 5,403,507

[45] Date of Patent: Apr. 4, 1995

[54] VAPOR CLEANING OF METALLIC AND ELECTRICAL MATERIALS UTILIZING ENVIRONMENTALLY SAFE SOLVENT MATERIALS

[75] Inventor: Richard G. Henry, Mayfield Heights, Ohio

[73] Assignee: Advanced Research Technologies, Park Ridge, Ill.

[21] Appl. No.: 109,719

[22] Filed: Aug. 20, 1993

[51] Int. Cl.[6] ..... C11D 7/50; C23G 5/02

[52] U.S. Cl. ..... 252/170; 252/162; 134/40

[58] Field of Search ..... 252/162, 170; 134/40

[56] References Cited

U.S. PATENT DOCUMENTS 4,056,403 11/1977 Cramer et al. ..... 134/22 R

*Primary Examiner*—Richard L. Raymond
*Assistant Examiner*—Brian G. Bembenick
*Attorney, Agent, or Firm*—Robert J. Black

[57] ABSTRACT

A solvent mixture for use in vapor cleaning degreasing systems. Dibromomethane is used as the principal component instead of such high ozone depleting chlorofluorocarbons as Freon and 1,1,1 Trichloroethane. Dibromomethane is mixed with other solvents including a number of low boiling solvents which prevent the mixture from becoming acidic on the release of bromine into the atmosphere.

13 Claims, No Drawings

VAPOR CLEANING OF METALLIC AND ELECTRICAL MATERIALS UTILIZING ENVIRONMENTALLY SAFE SOLVENT MATERIALS

BACKGROUND OF THE INVENTION

1. Field of the Invention

This invention relates to a method for cleaning articles by vapor degreasing; and more particularly to a method of removing organic materials from metallic and electrical materials with a solvent employing various blends including dibromomethane and appropriate stabilizers.

2. Background

The utilization of vapor degreasing techniques has found wide acceptance in industry in the past. This method of cleaning typically involves the heating of a solvent to a boil and the generation of a vapor layer into which the object to be cleaned is placed. This vapor layer is a mixture of air and solvent, where the air has reached the saturation point with the solvent. The vapor is generated by boiling the liquid. It condenses upon the object placed in the vapor layer and drips off of the object into a holding tank. This condensation dissolves the hydrocarbon contaminants and removes it from the object, thereby cleaning it.

This technique is a preferred method of cleaning precision parts, such as electronics, machined metallic parts, etc., since vapor cleaning leaves virtually no residue upon the parts.

Degreasing has been found particularly valuable for the removal of flux from soldered circuit boards. A typical circuit board consists of a thin plate normally of epoxy resin or similar material reinforced with glass fibers carrying electrical connectors on one or both sides consisting of thin strips of copper or other electrically conductive material. Electronic components are normally placed on the side opposite the conductors and by means of leads passing through holes in the board are attached to the connectors by crimping the leads followed by soldering. Soldering is typically carried out by first coating the connector side of the board with a flux and then passing the side of the board over a surface of molten solder. The fluxes employed in the use consist for the most part of rosin. Increasing popular in the trades are rosin fluxes which are activated by the addition of ionic materials. Such activators insure better solder bonds, especially on slightly corroded connectors and leads.

A choice of solvent for removal of the flux is restricted by the insuring; that the solvent will not attack the board or the various material of construction or any of the electronic components contained thereon. Alcohols have been used in the past, however, their use is limited because of the severe danger of fire. Nonflammable materials employed in the past as a solvent medium include CFC 113, 1,1,1 Trichloroethane, perchloroethylene, 1,1,1 Trichloroethylene and various hydrochlorofluorocarbons, such as "Gensolve" (manufactured by Allied Chemical).

Such vapor degreasing technique employing same or similar materials is taught by U.S. Pat. No. 3,881,949 which issued on May 6, 1975 to Carl Martin Brock.

The solvents described above and in the Brock patent are typically on the Clean Air Act list of ozone depleting chemicals and are being phased out of production. It is obvious from the foregoing that a suitable replacement is necessary to try to fill in for these banned ozone depleting chemicals.

U.S. Pat. No. 4,056,403 issued to Robert J. Cramer et al on Nov. 1, 1977 describes a method in which a number of non ozone depleting chemicals, including methylene bromide or dibromomethane are used in cleaning polyurethane foam generating equipment. Cramer et al teach a method wherein a solvent composition described therein is used for cleaning polyurethane foam generating apparatus or a segment thereof and noting particularly the cleaning operation where rinsing or flushing the entire foaming apparatus takes place after the foam forming chemicals have been exhausted. The solvents taught may be periodically injected under pressure through the mixer portion of the foaming apparatus in order to purge it of residual unreacted or partially foam forming materials. The method described in this patent would be totally ineffective because its composition does not include the appropriate stabilizers which would prevent the dibromomethane from becoming acid and thereby attacking the metal surfaces which might be placed into the vapor layer. Use of hot saturated vapors of a liquid halogenated hydrocarbon, including dibromomethane is taught in U.S. Pat. No. 4,193,838 which issued to Robert J. Kelly et al on Mar. 18, 1980. This patent teaches the maintenance of a pool of hot saturated vapors of a halogenated acyclic hydrocarbon then placing pieces of coated paper stock, which had been coated with "hot melt" coatings such as are used on consumer items and milk cartons, etc. These pieces of paper stock are placed in the vapor pool after which they are agitated. Again it is noted that this method would be ineffective at cleaning circuit boards and other metallic materials because of the acidic nature of the non stabilized compound utilized therein which would tend to destroy the object rather than just clean it.

Obviously it is the object of the present invention to provide materials which are suitable for vapor cleansing of electronic and metallic parts without the use of ozone depleting chemicals with a material that would not be appropriate for the cleaning of metal.

SUMMARY OF THE INVENTION

It is the primary purpose of the present invention to develop an environmentally safe "drop in" substitute for 1,1,1 TCE and CFC solvents which are utilized at the present in vapor degreasing equipment. It has been determined that dibromomethane because of its nonflammability, high solvency and very low ozone depleting potential is a very appropriate material for use in such solvents.

In the present invention, stabilized mixtures of dibromomethane will be added to a conventional vapor degreaser such as Baron-Blakeslee or Branson models. The thermostat would then be set at 210 degrees Fahrenheit with the included solvent allowed to reach this temperature after approximately ½ hour. At the temperature of 210 degrees Fahrenheit, the dibromomethane boils and this temperature must be reached obviously before any vapors appear. When the design temperature of 210 degrees Fahrenheit is attained, a vapor layer will appear above the solvent as a "fog". This fog constitutes the principal feature of cleaning by the vapor method. When the fog appears, an object can be placed into that vapor layer and the dibromomethane will condense onto the object. When such condensation takes place, any oil, grease, rosin, flux or similar organic material which was on the subjects will then be dissolved and will drip back down into the boiling solvent and thereby be removed, effectively cleaning the item deposited into the fog. The vapors from the solvent will not contain any of the removed contaminants and therefore be ready to clean more objects of any hydrocarbon soluble contaminants.

Most vapor degreasers include a cold side where excess solvent vapors can condense and then be recirculated back to the boiling side. This arrangement helps insure that there is fresh solvent boiling at all times. When the solvent becomes too contaminated with oil, grease or flux, the boiling point of the dibromomethane will increase. When the boiling point of the dibromomethane reaches 225 degrees Fahrenheit, it is time to change out the old material and replace it with fresh dibromomethane.

It has been found that dibromomethane can be stabilized with a mixture of three low boiling solvents to prevent it from turning acidic and releasing free bromine into the air. The solvents are nitromethane, 1,2 butylene oxide and 1,3, dioxolane. It was also discovered that excessive pitting and corrosion would appear on metals placed into the vapor layer unless appropriate stabilizers as indicated have been added. It has been determined that the appropriate ratio of the stabilizers is approximately 0.5% nitromethane, 0.5% of 1,2 butylene oxide and 3–4% 1,3 dioxolane. It has also been found that mixtures of dibromomethane and various terpene hydrocarbons and terpene alcohols as well as mineral spirits, glycol ethers, alcohols, and ketones can be used in conjunction with the above identified stabilizers. It has also been determined that some mixtures will make cloudy solutions indicating that the two components are not necessarily completely compatible. By mixing two solvents together, a wide variety of soils or contaminants can be removed. Some of the acceptable combinations are described in Table 1 below.

TABLE 1

| PRODUCT | SOLUTION CLARITY | VAPOR LAYER |
|---|---|---|
| Dibromomethane/limonene/stabilizers | Clear | Yes |
| Dibromomethane/Dipentene/stabilizers | Clear | Yes |
| Dibromomethane/mineral spirits/ stabilizers | Clear | Yes |
| Dibromomethane/glycol ethers/ stabilizers | Cloudy | Trace |
| Dibromomethane/acetone/stabilizers | Cloudy | Trace |
| Dibromomethane/Isopropyl Alcohol/ stabilizers | Cloudy | Trace |

DETAILED DESCRIPTION OF THE PREFERRED EMBODIMENTS

A better understanding of the present invention can be had by reference to the following description particularly to several included examples to outline the vapor degreasing solvent which effectively meets the object outlined above.

Dibromomethane when properly stabilized and blended with various solvents may be utilized as a vapor degreasing solvent in standard sump type or ultrasonic vapor degreasing equipment as a replacement for 1,1,1 trichloroethane and chlorofluorocarbon solvents. A vapor degreasing solvent should have the following characteristics for proper cleaning of metal, plastic, elastomers, and circuit boards. 1) it must be properly stabilized. 2) be non-flammable and should have an ozone depletion potential of less than 0.2. It should also have a high solvency with a Kauri-Butanol value above 70. Additionally, it should include an evaporation rate of at least 3 and on evaporation leave behind no residue. The solvent should have a latent heat evaporation of 31 Kcal/mole so as to facilitate condensation of the solvent on the chiller side of a standard degreasing system.

One preferred embodiment, is a standard sump type vapor degreaser 5 gallons of a 90% dibromomethane mixture stabilized by the addition of 0.5% nitromethane, 0.5%, 1,2 butylene oxide, 4% 1,3 dioxolane and 5% dipentene mixture. The total being blended and added together. The thermostat on the vapor degreaser is adjusted to 210 degrees Fahrenheit and the system was allowed to equilibrate. After the mixture inside the solvent reservoir reached 210 degrees Fahrenheit, the mixture began to boil. A vapor layer of approximately 7 inches deep was observed inside the unit. Enough vapor was being evolved so as to condense and be circulated from the chilled side of the degreaser and be returned to the boiling side.

A circuit board having approximately 1 gram of rosin flux was immersed into the observed vapor layer. Dibromomethane was then seen to condense onto the circuit board and dissolve the rosin flux. After approximately one minute had passed, the circuit board was removed from the vapor layer. The observed circuit board contained no rosin flux. The flux had been removed by the solvent vapor and dripped off into the boiling solvent. The same procedure outlined above was tried for pieces of sheet metal containing light mineral oils, silicone oils, lithium greases and other types of industrial release fluids. Similar results were obtained.

In another embodiment of the present invention, five gallons of the above composition were added to a vapor degreaser with dipentene being replaced by p-menthane. Again, the thermostat was adjusted to 210 degrees Fahrenheit and the system was allowed to equilibrate. After the solvent blend reached 210 degrees Fahrenheit, a vapor layer approximately 7 inches deep was again observed inside the solvent reservoir. A steel bolt was placed inside the vapor layer which had lithium soap based grease smeared on it. After 1 one minute has passed, the bolt was removed from the vapor layer. All of the lithium soap based grease had been removed and the part was now completely clean.

Other approaches included using the same mixture as above with mineral spirits added in place of the dipentene as part of the total solvent mixture added to the boiling sump of a vapor degreaser. Again, similar results were obtained.

Finally, mixtures of 5% C1, C2, C3, C4, C5, C6, C7, C8, C9, C10, C11 and C12 alcohols with one OH group were individually substituted for the dipentene in the initial example. Hereto, similar results were obtained.

Thus, it can be seen from the foregoing that a properly stabilized mixture of dibromomethane and various solvents can effectively be utilized as a vapor cleaning solvent in the effective cleaning of organic materials from the surfaces of electrical and metallic parts.

Corrosion tests were also performed as oxidation is a potential problem as with all solvent cleaners. In performing these tests, strips of copper and steel measuring 1" wide by 6" long and of 20 mil thickness were buffed on a belt sander to remove any oxide films. Fifty milliliters of the above mentioned solvents were placed in a cylindrical Pyrex glass container and strips were placed in so that 75% of the surface was immersed in the solvent. A sample container filled with tap water was used as a control for the test. This would insure that there were no alloys in the metal strips that would have been prevented oxidation. The openings of the sample containers were all sealed with cork stoppers to reduce evaporation. After an appropriate time, the strips were removed and it was determined that all of the solvent types described above all were found to be non-corrosive.

While but selected embodiments of the present invention have been shown, it will be obvious to those skilled in the art that numerous modifications may be made without departing from the spirit of the present invention, which shall be limited only by the scope of the claims appended hereto.

What is claimed is:

1. A solvent mixture having an ozone depletion factor of less than 0.2, for use in a vapor degreasing system, comprising:

90% dibromomethane;

5% of another solvent drawn from a group consisting of terpene hydrocarbons, terpene alcohols, mineral spirits, glycol ethers and alcohol;

4 to 5% of a mixture of low boiling solvents comprising 0.5% nitromethane, 0.5% 1,2 butylene oxide, 4% 1,3 dioxolane, operated to inhibit the release of bromine into the atmosphere from said dibromomethane.

2. A solvent mixture as claimed in claim 1 wherein: said 5% of another solvent is limonene.

3. A solvent mixture as claimed in claim 1 wherein: said 5% of another solvent is dipentene.

4. A solvent mixture as claimed in claim 1 wherein: said 5% of another solvent is mineral spirits.

5. A solvent mixture as claimed in claim 1 wherein: said 5% of another solvent is a glycol ether.

6. A solvent mixture as claimed in claim 1 wherein: said 5% of another solvent is acetone.

7. A solvent mixture as claimed in claim 1 wherein: said 5% of another solvent is an alcohol.

8. A solvent mixture as claimed in claim 1 wherein: said 5% of low boiling solvents act to inhibit said dibromomethane from becoming acidic while in operation in a vapor degreaser.

9. A solvent mixture as claimed in claim 1 wherein: said solvent mixture is non-flammable.

10. A solvent mixture as claimed in claim 1 wherein: said solvent mixture has a high solvency with a Kauri-Butanol value above 70.

11. A said solvent mixture as claimed in claim 1 wherein:

said solvent mixture has an evaporation rate of at least 3.

12. A solvent mixture as claimed in claim 1 wherein: the solvent mixture in operation in a vapor degreasing system leaves no residue.

13. A solvent mixture as claimed in claim 1 wherein: said solvent mixture has a latent heat evaporation of 31 Kcal/mole, facilitating condensation of the solvent in a vapor degreasing system.

* * * * *